United States Patent [19]

Mills

[11] Patent Number: 4,650,191

[45] Date of Patent: Mar. 17, 1987

[54] GOLF CLUB

[76] Inventor: Truett P. Mills, 1700 Second Ave., Tuscaloosa, Ala. 35401

[21] Appl. No.: 674,408

[22] Filed: Nov. 23, 1984

[51] Int. Cl.[4] ..... A63B 69/36; A63B 53/04

[52] U.S. Cl. ..... 273/164; 273/169; 273/186 A; 273/80 A

[58] Field of Search ..... 273/80 A, 169, 171, 273/172, 168, 164, 170, 173, 174, 175, 167 F, 183 D, 186 A, 193 R, 194 R, 194 A, 194 B

[56] References Cited

U.S. PATENT DOCUMENTS

| | | | |
|---|---|---|---|
| D. 242,730 | 12/1976 | Pappas | D34/5 GC |
| D. 258,377 | 2/1981 | Nordness | D21/217 |
| 669,864 | 3/1901 | Simpson | 273/80 C |
| 1,467,714 | 9/1923 | Doerr | 273/168 X |
| 1,525,137 | 2/1925 | Lawton | 273/80 A |
| 1,705,250 | 3/1929 | Hincks | 273/80 C |
| 3,039,776 | 6/1962 | Faini | 273/164 |
| 3,077,350 | 2/1963 | Koorland | 273/80 C |
| 3,194,564 | 7/1965 | Swan | 273/186 A |
| 3,384,376 | 5/1968 | Greenlee | 273/164 |
| 3,392,977 | 7/1968 | Lacey | 273/164 X |
| 3,448,981 | 6/1969 | Anweiler | 273/80 C |
| 3,529,826 | 9/1970 | Hulyk | 273/80 C |
| 3,539,184 | 11/1970 | Koorland | 273/77 R |
| 3,806,129 | 4/1974 | Burrows | 273/164 |
| 3,841,640 | 10/1974 | Gaulocher | 273/164 |
| 3,881,733 | 5/1975 | Csernits | 273/168 |
| 3,888,484 | 6/1975 | Zitko | 273/80 C |
| 3,954,265 | 5/1976 | Taylor | 273/80 C |
| 3,966,210 | 6/1976 | Rozmus | 273/80 C |
| 3,967,826 | 7/1976 | Judice | 273/80 C |
| 4,010,958 | 3/1977 | Long | 273/169 |
| 4,063,733 | 12/1977 | Benedict | 273/80 C |
| 4,138,117 | 2/1979 | Dalton | 273/164 |
| 4,165,076 | 8/1979 | Cella | 273/168 |
| 4,227,694 | 10/1980 | Drake | 273/164 |
| 4,253,667 | 3/1981 | Clark et al. | 273/168 |
| 4,265,452 | 5/1981 | Vella | 273/80 C |
| 4,383,690 | 5/1983 | Maxwell | 273/164 |

*Primary Examiner*—George J. Marlo
*Attorney, Agent, or Firm*—Dority & Manning

[57] ABSTRACT

An improved golf club including a club head having a shaft secured thereto and extending upwardly therefrom, the club head having a front surface defining a ball striking area, a top surface, a rear surface and bottom surface, and heel and toe portions. Weighting members are provided on said front surface at both heel and toe portions which extend outwardly therefrom. The location and weight of the weighting elements places the center of gravity of the club head at least as far forward as the front striking area and preferably in front of same. Vertical location of the center of gravity is also preferably above a horizontal center line through the club head for a putter and preferably below the center line for an iron.

11 Claims, 6 Drawing Figures

GOLF CLUB

BACKGROUND OF THE INVENTION

The present invention relates to improved golf clubs, particularly putters where the club is designed to facilitate improved reaction of a ball struck thereby.

BACKGROUND OF THE INVENTION

Much effort has been expended previously in the art of golf club design to improve the golfer's game by alleviating, or attempting to alleviate inaccuracies that are introduced by the player during swinging of the club. Such inaccuracies have been directed to faulty club design as well as physical imperfections of the player in approaching the ball, swinging the club and the like. One such area in which much attention has been directed, and to which the present invention is particularly relevant, is that of putting.

As is readily apparent to those of ordinary skill in the art, putters have heretofore been developed with various and sundry design features provided for aesthetics and/or to assist the golfer in properly aligning the club and the ball prior to stroking of the ball; to compensate for deviation in the player's swing; to compensate for torque created at the point of impact with the ball by virtue of the conventional club design; and the like. Likewise, many putter designs have been provided, not for actual play of the game, but for instructional or practice purposes to better prepare the player for putting during the game. Such designs have included appurtances integral with or removably securable to conventional putters that extend forwardly of the striking surface or area of the putter to either bracket the "sweet spot" of the putter or for actual striking of the ball. Other prior features include slots, lines and the like that are provided to enhance alignment.

In general, all known prior art putters have located the mass of the putter head behind the striking face, though as pointed out hereinafter, with variation. Such arrangement tends to create lift to the ball at impact which may cause the ball to bounce along the green and thus become more subject to deviation from the intended line of movement to the hole. A bouncing ball is also more apt to change the distance of roll.

While shifting of mass and thus the center of gravity of the club head has been achieved, the mass has still been maintained behind the striking face, and thus has not achieved the attributes of the golf club of the present invention.

The Judice U.S. Pat. No. 3,967,826, for example, discloses a putter having a shaft retainer extending forwardly of the face of the putter and upwardly to receive a shaft. A recess is provided in the bottom surface of the putter head, located to provide additional weighting in the toe of the putter head to compensate for the shaft offset. Axes through the shaft and the vertical center of gravity of the putter head extend through the center of a ball centrally located in front of the putter head. Such design is stated to eliminate or reduce torquing action at impact. Benedict, U.S. Pat. No. 4,063,733 offsets the point of attachment of the shaft to the club head forward of the center of gravity of the head, again to counter torque that is normally present with a conventional club. The Faini U.S. Pat. No. 3,039,776 discloses protrusions from the face of a putter that may be separated from the putter, or of integral construction therewith, and which are provided for ball alignment purposes only. Likewise, other patents, listed below disclose other golf club designs, including those on which projections or protrusions extending beyond the face of a putter.

| | |
|---|---|
| D.242,730 | D.258,377 |
| 669,864 | 1,705,250 |
| 3,039,776 | 3,077,350 |
| 3,194,564 | 3,384,376 |
| 3,448,981 | 3,529,826 |
| 3,539,184 | 3,806,129 |
| 3,967,826 | 3,841,640 |
| 3,881,733 | 3,888,484 |
| 3,954,265 | 3,966,210 |
| 4,010,958 | 4,063,733 |
| 4,138,117 | 4,165,076 |
| 4,227,694 | 4,253,667 |
| 4,265,452 | |

The above noted known prior art, while disclosing structures somewhat similar to that of a golf club according to teachings of the present invention neither anticipate nor suggest same.

SUMMARY OF THE INVENTION

It is an object of the present invention to provide an improved golf club which will affect enhanced reaction of a ball being struck thereby.

A further object of the present invention is to provide an improved putter which is designed to lessen the likelihood of imparting lifting forces to a ball being struck thereby.

Still further another object of the present invention is to provide an improved putter which is designed to afford improved forward spin to the ball struck thereby.

Still further another object of the present invention is to provide an improved golf club where the center of gravity of the club head is located forwardly of the geometrical center of the club head at least as far as the frontal striking area.

Yet another object of the present invention is to provide an improved putter in which the center of gravity of the putter head is located forwardly of the ball striking area of the putter head, and above a horizontal center line extending through the heel and toe portions of the club head.

Generally speaking, the golf club of the present invention comprises a club head and a shaft secured thereto and extending upwardly therefrom, said club head comprising a body having a front surface defining a ball striking area, a top surface, a rear surface, and a bottom surface, and heel and toe portions, said club head further having weighting means associated therewith at both heel and toe portions, said weighting means being coordinated as to shape and weight such that the center of gravity of said club is located at least as far forward as said striking area, and defining said striking area therebetween.

More specifically, the improved golf club according to the present invention, preferably a putter, is preferably provided with weighting means secured to the club head and extending outwardly from the front surface of the club head at both heel and toe portions. The weighting means define the ball striking area therebetween while being located far enough apart as to avoid a likelihood of the weighting means inadvertently contacting the ball. In a most preferred embodiment, the weighting means are integral with the front surface of the club head at both heel and toe portions and are located, at least primarily above a center line that extends horizontally through the club head from the heel to the toe portions. With such an arrangement, the center of gravity of the club head may be located forwardly of the frontal striking area and above the center line, such that during use when a ball is struck thereby an overspin is imparted to the ball, producing improved rolling action of the ball. While such is preferred for putters, for irons, the center of gravity is preferably also at the striking face or beyond, but below the center line.

Weighting means for golf clubs according to the present invention may be of unitary construction with the club head, having been produced from a single block of metal, casting or the like. Considerable variation may be provided for the weighting means as to size, shape, density and the like. In this regard, the weighting means may be of a dissimilar or denser metal than that of the remainder of the club head and secured thereto by welding, brazing or the like. Also, the weighting means may be hollow elements in which a particular weighting material is received. Accordingly, the clubs according to the present invention may be custom designed to accurately locate the center of gravity of the club head at a particular predetermined location either coincident with the striking area or forwardly of same.

In addition to weighting of the club head to locate the center of gravity of same at a particular location, weighting considerations may also be made, depending upon the particular weighting means being applied, location of the point of securement between the shaft and the club head, and the like, to reduce or alleviate torque created at the point of impact of the ball as has been discussed in the prior art. Likewise, the body of the club head rearward of the front surface may be slotted, weighted, cut-away, or the like to achieve other characteristics for the golf club, so long as the particular club head design does not alter the desired center of gravity location.

BRIEF DESCRIPTION OF THE FIGURES

The construction designed to carry out the invention will be hereinafter described, together with other features thereof.

The invention will be more readily understood from a reading of the following specification and by reference to the accompanying drawings forming a part thereof, wherein embodiments of the invention are shown and wherein.

DESCRIPTION OF A PREFERRED EMBODIMENT

Figure 1:
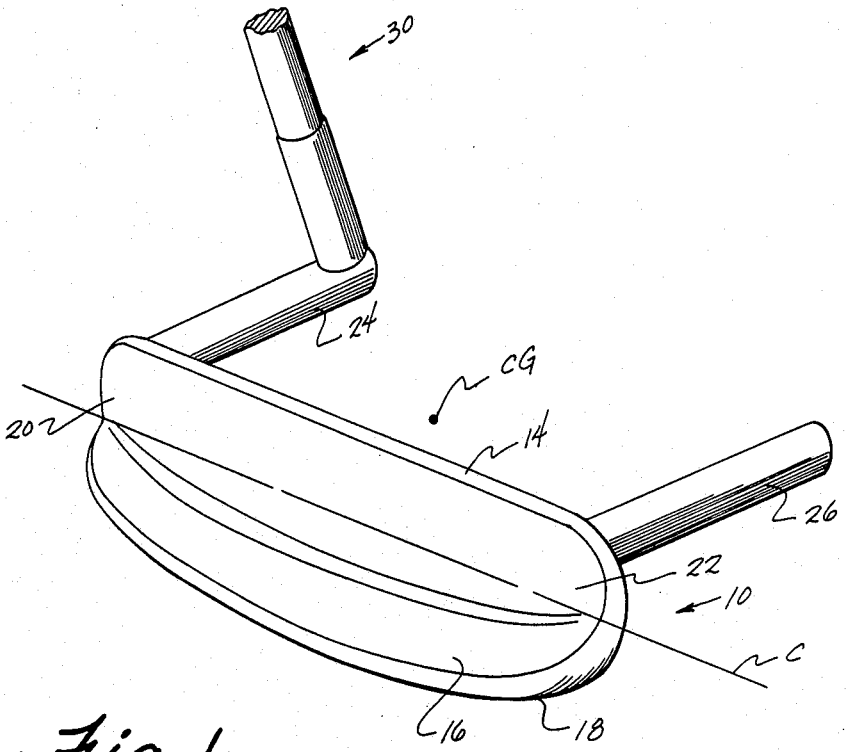
FIG. 1 is an isometric view of a portion of a golf club according to teachings of the present invention.
Figure 2:
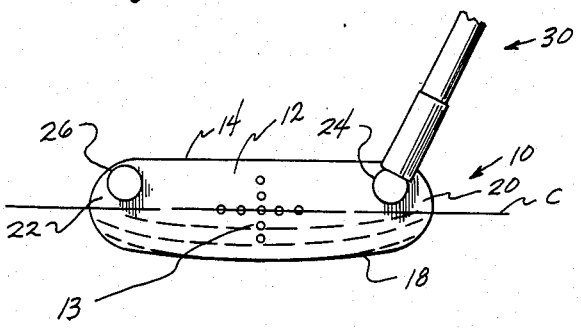
FIG. 2 is a frontal elevational view of a portion of a golf club as illustrated in FIG. 1.
Figure 3:
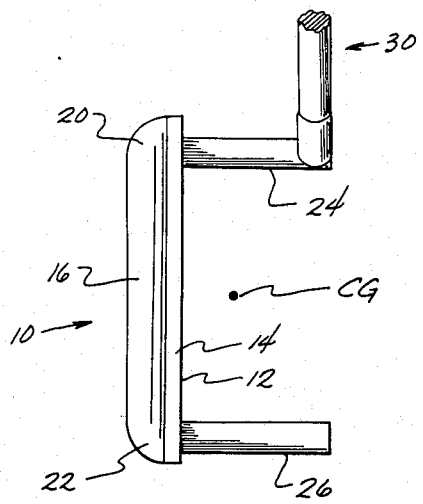
FIG. 3 is a top plan view of a portion of a golf club as illustrated in FIG. 1.

Making reference to the figures, preferred embodiments of the present invention will now be described in detail. FIGS. 1-3 illustrate a preferred embodiment of the present invention in which a club head generally indicated as 10 is provided having a shaft generally indicated as 30 secured thereto and extending upwardly therefrom in conventional fashion. As is apparent from FIGS. 1-3, a putter is being portrayed in which the club head 10 includes a front surface 12, a top surface 14, a rear surface 16, and a bottom surface 18. Club head 10 further includes a heel portion 20 and a toe portion 22. So far the description of the putter club head is conventional, and it should be pointed out that the overall shape of the club head per se is not critical so long as the following described conditions are met.

Club head 10 is provided with weighting means 24, 26 secured to heel and toe portions 20 and 22, respectively which extend forwardly from the front surface 12. As illustrated in FIGS. 1-3, weighting means 24, 26 are cylindrical elements that not only extend forwardly of front surface 12 of club head 10, but also are located above a center line C that extends horizontally through the club head from heel portion 20 through toe portion 22. Such is particularly preferred for putters. As such, with the particular weight of weighting means 24, 26 and the particular size of same being predetermined, the center of gravity, CG, may be located forwardly of the geometrical center point of head 10, at least as far forward as the front surface 12, and in a most preferred embodiment, as indicated in FIG. 1 is forward of front surface 12 and above center line C.

In addition to locating the center of gravity CG of club head 10 at or forwardly of the front surface 12, weighting means 24, 26 additionally serve as alignment means to enable one using the club to properly align a the ball prior to putting, yielding improved putting accuracy. Obviously the ball striking area 13 (see FIG. 2) located between weighting means 24 and 26 makes point contact with a ball during the putting stroke. In this regard, it is important that weighting means 24, 26 are adequately spaced apart to ensure that an adequate ball striking area 13 is afforded for the player. In addition to the location of the center of gravity at, or forward of the frontal striking area 13 of the golf club to impart an overspin rolling action for the ball, this particular weighting arrangement also enlarges the "sweet spot" of the club by reducing torquing tendency of the club. Hence, should one using the club strike the ball slightly away from the conventional "sweet spot", there is less likelihood of improper reaction resulting therefrom.

Figure 4:
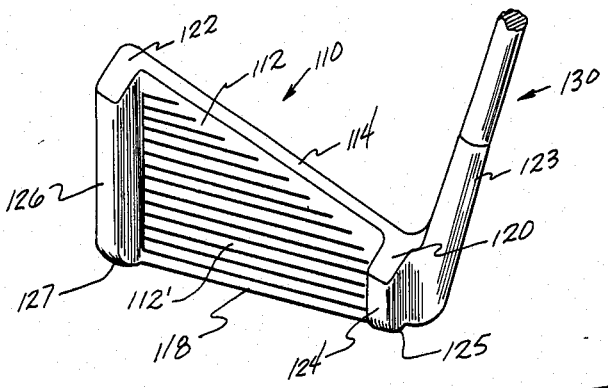
FIG. 4 is an isometric view of a further embodiment of a golf club according to teachings of the present invention in the form of an iron.

Making reference to FIG. 4, a further embodiment of the present invention is illustrated. Particularly a pertinent portion of an iron type golf club is provided, wherein a club head generally 110 has a shaft generally 130 secured thereto and extending upwardly therefrom. The club head 110 includes a front surface 112 which defines a ball striking area 112' indicated by the conventional horizontal lines, a top surface 114, a rear surface (not shown) and a bottom surface 118. Additionally, the club head includes a heel portion 120 and a toe portion 122, with a hosel 123 located at heel portion 120 and extending angularly upwardly therefrom, receiving shaft 130 therewithin. Weighting means 124, 126 are provided at toe and heel portions 120, 122, respectively, and are of unitary construction therewith. Weighting members 124, 126 in essence cover the front surface 112 outside of striking area 112', and extend forwardly therefrom. Weighting member 126 is larger in size and therefore greater in weight than weighting member 124. In this particular arrangement, the smaller size of the heel weighting member 124 takes the extra weight of the hosel 123 into consideration. With such arrangement, as has been previously described with respect to FIGS. 1–3, the center of gravity of club head 110 is located at least as far forward as the striking face 112. For iron clubs as opposed to putters, it is preferred that the center of gravity CG be vertically located at a level below the horizontal center line as discussed with respect to FIGS. 1–3.

In iron play, it is desirable for the club to bite into the turf behind the ball, take an appropriate divot and make contact with the ball. Weighting members 124, 126 properly locate the center of gravity of the club head as discussed above, and also assist in proper alignment or address of the ball. Likewise with lower leading edges 125, 127 of members 124, 126 as shown in FIG. 4, when the club bites into the turf, weighting members 124, 126 will guide the club at an appropriate angle and also limit the depth of bite.

A still further embodiment of the present invention is illustrated in FIG. 5, again in the context of a putter and includes a putter head generally 210 having a shaft (not shown) secured thereto and extending upwardly therefrom in conventional fashion. Club head 210 includes a frontal striking surface 212, a top surface 214, a rear surface 216 and a bottom surface 218, with heel and toe portions 220, 222. As particularly illustrated, weighting members 224, 226 are of unitary construction with head 210 and extend outwardly from an upper portion of same, generally above a center line C that extends horizontally through club head 210 from heel to toe portions. In this regard, note that weighting elements 224, 226 have rounded outer ends 224', 226' with tapered or undercut portions 225, 227, respectively, extending from the outer ends of same inwardly to bottom surface 218. In this fashion, as mentioned above, the center of gravity of the club head 210 is located forwardly of striking plate 212, and above center line C such that when one utilizing the putter of FIG. 5 strikes the ball on a green, the ball will react with an overspin rolling motion yielding a more accurate overall putting stroke.

Figure 5:
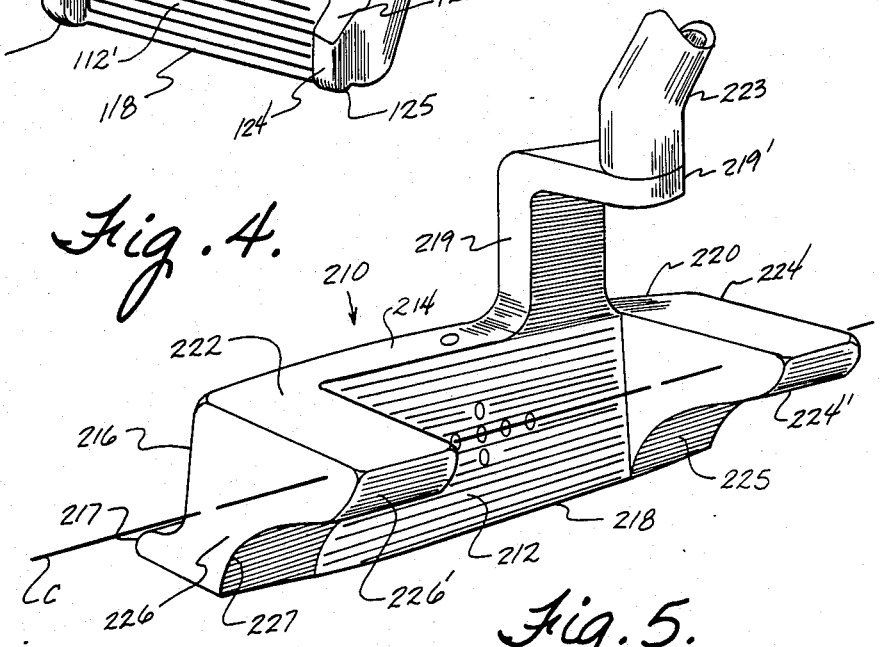
FIGS. 5 and 6 are isometric views of further embodiments of putters according to teachings of the present invention.

Putter head 210 of FIG. 5 further includes a rear flange 217 that extends rearwardly from bottom surface 218 having an upper taper to rear wall 216. As mentioned herein this feature of putter head 210 is not critical so long as the proper weighting characteristics of the club head are present. Club head 210 also is provided with an upwardly protruding mounting element 219 having a forward projecting flange 219' secured to an upper end of same. A shaft retainer 223 is secured to flange 219' for receipt of a shaft (not shown). As illustrated, shaft retainer 223 is appropriately bent to afford an offset characteristic for shaft mounting to club head 210.

Figure 6:
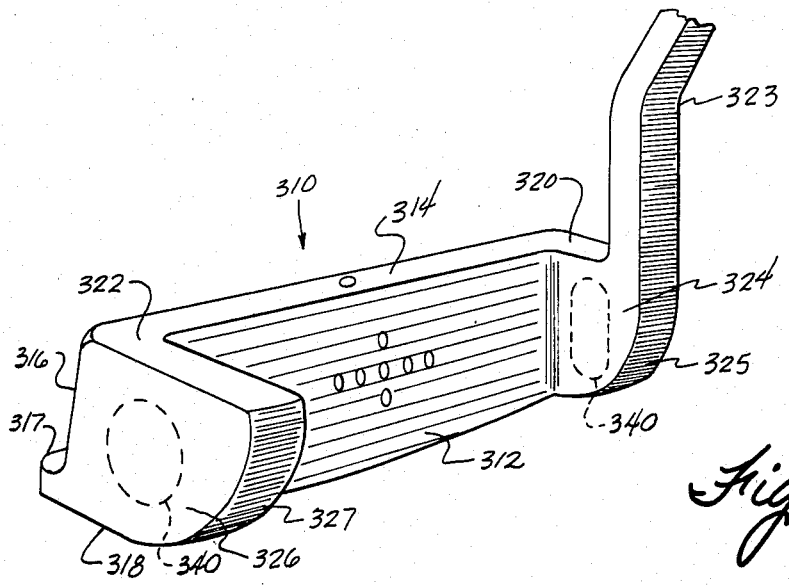

FIG. 6 illustrates a further putter embodiment according to the present invention wherein a club head 310 is provided, again of unitary construction, which includes a front, ball striking area 312, a top surface 314, a rear surface 316, and a bottom surface 318. Weighting members 324, 326 are of unitary construction with club head 310 and extend outwardly from heel and toe portions 320, 322, respectively. The weighting means may, as noted above, include hollow elements in which a particular weighting material, such as a lead insert 340, is received. As shown in FIG. 6, a shaft retainer 323 is likewise of unitary construction with club head 310 and extends upwardly from an outer end of weighting member 324 to receive a shaft (not shown). In order to compensate for the additional weight of the shaft retainer 323, weighting member 326 is shown larger than member 324, again to place the center of gravity of club head 310 at least as far forward, and preferably in front of the striking area 312, as well as preferably above a center line passing horizontally through club head 310 in the fashion described above.

It will be understood, of course, that while the form of the invention herein shown and described constitutes a preferred embodiment of the invention, it is not intended to illustrate all possible forms of the invention. It will also be understood that the words used are words of description rather than of limitation and that various changes may be made without departing from the spirit and scope of the invention herein disclosed.

What is claimed is:

1. A golf club comprising a club head and a shaft secured thereto and extending outwardly therefrom, said club head comprising a front surface defining a striking area, a bottom surface, a top surface and heel over toe portions, said front surface having weighting means associated therewith at both said heel and toe portions, said weighting means being coordinated as to shape and weight to locate the center of gravity of said club head at least as far forward as said front surface and defining said striking area therebetween, and said weighting means being secured to said front surface and extending forwardly therefrom, said weighting means further having generally parallel spaced apart inner walls and defining a minority of the transverse dimension of said front surface to permit contact between a golf ball and the striking area of the front surface while avoiding the likelihood of contact between the ball and the weighting means.

2. A golf club as defined in claim 1 wherein said shaft is secured to said weighting means located at said heel portion.

3. A golf club as defined in claim 1 wherein said weighting means are located on said front surface above a horizontal center line through said head extending through said heel and toe portions.

4. A golf club as defined in claim 1 wherein said weighting means are cylindrical in nature.

5. A golf club as defined in claim 1 wherein said head further includes a shaft retainer, said shaft being secured therein.

6. A golf club as defined in claim 1 wherein said head has a flange portion located behind said front surface adjacent said bottom surface, and extending outwardly therefrom.

7. A golf club as defined in claim 1 wherein said weighting means extend outwardly from said front surface at a location above a horizontal center line through said head with said center of gravity being located forward of said striking area and above a center line through said head that extends through said heed and toe portions.

8. A golf club as defined in claim 1 wherein said weighting means are of unitary construction with said body and extend outwardly thereform.

9. A golf club as defined in claim 1 wherein said weighting means contain a weighting material.

10. A golf club as defined in claim 1 wherein said club is an iron and said center of gravity is also located below a center line through said head that extends through said heel and toe portions.

11. A golf club as defined in claim 10 wherein said weighting means have undercut portions along lower frontal surfaces of same to control the depth of bite of the club into the ground during play.

* * * * *